US005360248A

United States Patent [19]

Jones

[11] Patent Number: 5,360,248

[45] Date of Patent: Nov. 1, 1994

[54] BEARING CAP SPREADER

[75] Inventor: Joel W. Jones, Windsor, Canada

[73] Assignee: Tri-Way Machine Ltd., Windsor, Canada

[21] Appl. No.: 62,749

[22] Filed: May 18, 1993

[51] Int. Cl.[5] ..... B66C 1/42

[52] U.S. Cl. ..... 294/87.1; 414/751

[58] Field of Search ..... 294/81.54, 81.62, 87.1, 294/119.1, 65; 414/749–753

[56] References Cited

U.S. PATENT DOCUMENTS

| | | | |
|---|---|---|---|
| 2,670,983 | 3/1954 | Breslav | 294/81.54 |
| 3,287,057 | 11/1966 | Gallapoo | 294/81.62 |
| 4,444,423 | 4/1984 | Montferme | 294/65 X |
| 5,005,889 | 4/1991 | Nerger et al. | 294/119.1 X |
| 5,078,570 | 1/1992 | Loock | 414/751 |

FOREIGN PATENT DOCUMENTS

| | | | |
|---|---|---|---|
| 1282896 | 11/1968 | Germany | 294/87.1 |
| 120805 | 12/1970 | Norway | 294/87.1 |
| 632637 | 11/1978 | U.S.S.R. | 294/87.1 |

*Primary Examiner*—Dean J. Kramer

*Attorney, Agent, or Firm*—Shoemaker & Mattare, Ltd.

[57] ABSTRACT

Apparatus for moving workpieces from a relatively close spacing to a relatively distant spacing includes a block supporting a gear shaft for rotation, the gear shaft defining at least one pinion gear and at least two elongated rack elements which engage the pinion gear at diametrically opposed locations, so that rotation of the gear shaft causes the racks to slide in opposite directions. The racks are connected to gripping devices which can grip the workpieces for movement therewith.

4 Claims, 4 Drawing Sheets

BEARING CAP SPREADER

This invention relates generally to the simultaneous manufacture of a plurality of substantially identical mechanical items, and has to do particularly with an improvement in the manufacturing of automotive-type crankshaft bearing caps. It is to be understood, however, that this invention is not considered to be limited to the manufacture of automobile components.

BACKGROUND OF THIS INVENTION

In the manufacture of crankshaft bearing caps for automobile engines, up to five bearing caps were cast together as a unit referred to in the trade as a "monoblock". The monoblock process consisted of casting several items of a similar shape as a single piece, and then separating them by sawing or broaching into several individual items. For many years, the monoblock casting method has been used for crankshaft bearing caps.

Prior to 1987, all machining of bearing cap bolt holes was done while the individual bearing caps remained in the monoblock condition (i.e. not separated from one another). In that earlier process, the separation into individual bearing caps was carried out as one of the last machining operations.

In 1987, however, the manufacturing processing of automotive-type crankshaft bearing caps was changed dramatically. Although the casing of the bearing caps as a monoblock did not change, the means of dimensioning the finished individual bearing caps changed considerably. The dimensional changes required the development of new methods to handle the bearing caps between the manufacturing operations.

Essentially, the new dimensioning requirements involved tighter tolerances relative to the side and lock notch faces, and required that bolt hole machining be accomplished after the separation of the monoblock into individual bearing caps. In order to properly fixture the individual bearing caps after division of the monoblock, the caps must be separated or spread apart. The present invention provides an apparatus capable of accurately spreading apart the various bearing caps into which monoblock is divided. Again it is emphasized that although the present apparatus was developed specifically for crankshaft bearing caps, the underlying concept of the design is applicable to any parts with similar shapes.

GENERAL DESCRIPTION OF THIS INVENTION

In view of the above, it is an object of one aspect of this invention to provide an apparatus capable of receiving several substantially identical workpieces, originally cast or forged as a single piece and subsequently separated, and spreading them some equal distance apart. The purpose of spreading the workpieces apart is to simplify the means of transferring them and to improve the accuracy of locating and fixturing them.

More particularly, this invention provides an apparatus for moving at least two workpieces between a relatively close spacing and to a relatively distant spacing, comprising:

a support block, a gear shaft having an axis of rotation, and being mounted to the support block for rotation about said axis, a pinion gear means on the gear shaft, the pinion gear means rotating with the gear shaft and having pinion gear teeth, a first elongate rack means supported by said support block for longitudinal sliding movement in a direction perpendicular to the axis of rotation of the gear shaft, and defining a first rack of gear teeth meshing with the teeth of said pinion gear means, a second elongate rack means supported by said support block for longitudinal sliding movement parallel with the direction of movement of said first elongate rack means, and defining a second rack of gear teeth meshing with the teeth of said pinion gear means, the first and second elongate rack means engaging the pinion gear means at diametrically opposed locations, whereby rotation of the gear shaft causes the two elongate rack means to slide in opposite directions, first gripping means mounted for movement with the first elongate rack means, the first gripping means being adapted to grip a first workpiece such that the first workpiece, after being gripped, moves with the first elongate rack means, second gripping means mounted for movement with the second elongate rack means, the second gripping means being adapted to grip a second workpiece such that the second workpiece, after being gripped, moves with the second elongate rack means, and drive means for rotating the gear shaft in a controlled manner.

Optionally, the apparatus described above may further comprise:

a further pinion gear means on the gear shaft, the further pinion gear means rotating with the gear shaft and having further pinion gear teeth, a third elongate rack means supported by said support block for longitudinal sliding movement in a direction parallel with the direction of movement of said first elongate rack means, and defining a third rack of gear teeth meshing with the teeth of said further pinion gear means, a fourth elongate rack means supported by said support block for longitudinal sliding movement parallel with the direction of movement of said first elongate rack means, and defining a fourth rack of gear teeth meshing with the teeth of said further pinion gear means, the third and fourth elongate rack means engaging the further pinion gear means at diametrically opposed locations, whereby rotation of the gear shaft causes the third and fourth elongate rack means to slide in opposite directions, third gripping means mounted for movement with the third elongate rack means, the third gripping means being adapted to grip a third workpiece such that the third workpiece, after being gripped, moves with the third elongate rack means, and fourth gripping means mounted for movement with the fourth elongate rack means such that the fourth workpiece, after being gripped, moves with the fourth elongate means, the fourth gripping means being adapted to grip a fourth workpiece.

GENERAL DESCRIPTION OF THE DRAWINGS

One embodiment of this invention is illustrated in the accompanying drawings, in which like numerals denote like parts throughout the several views, and in which.

DETAILED DESCRIPTION OF THE DRAWINGS

Figure 1:
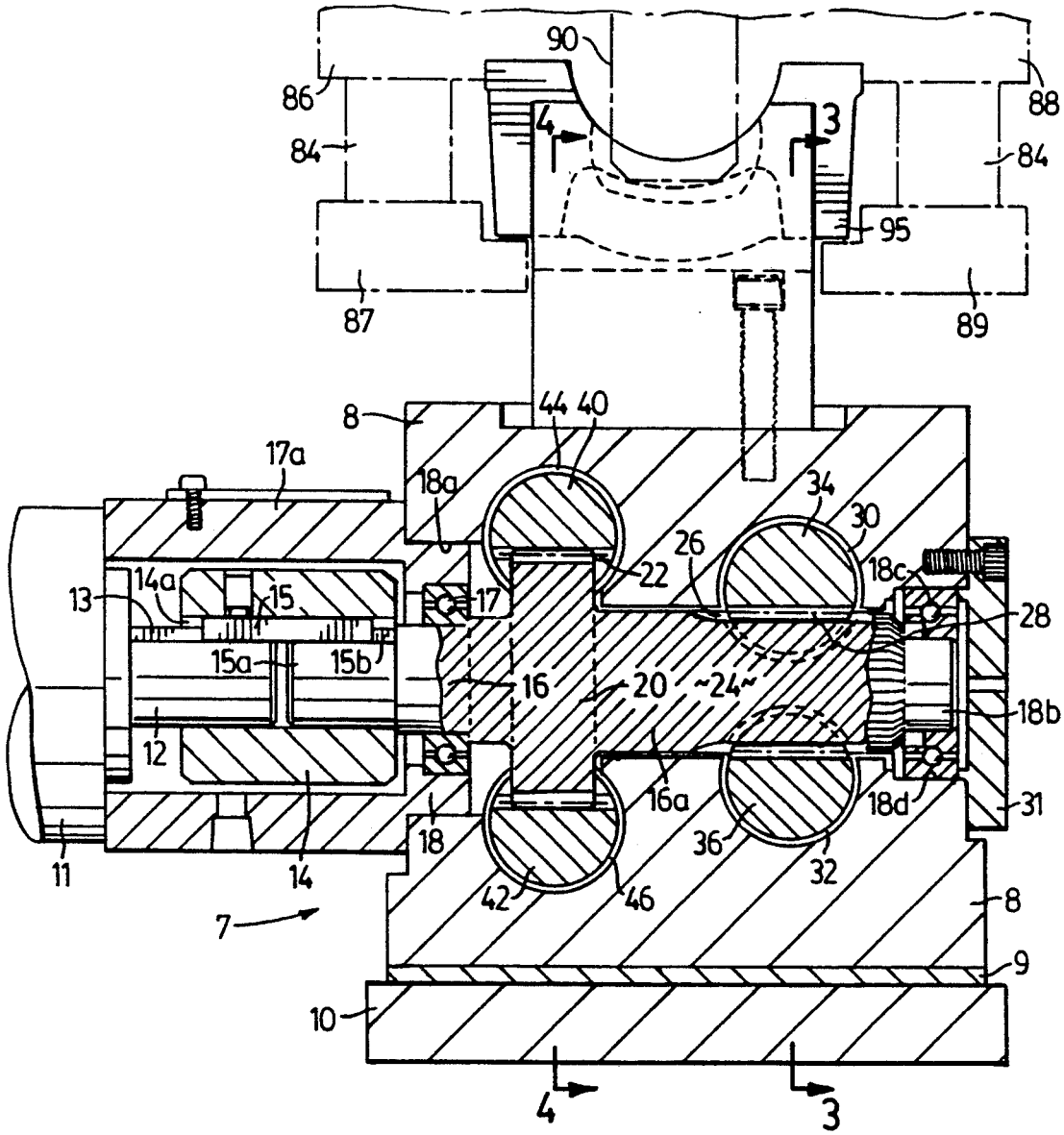
FIG. 1 is a vertical sectional view taken axially of the rotatable gear shaft forming part of a bearing cap spreader constructed in accordance with this invention.

FIG. 1 identifies the basic elements needed to perform the separation of the several bearing caps. In FIG. 1, the apparatus shown generally at 7 includes a support block 8 which is seen to be generally rectangular in the cross-section view shown in FIG. 1. The support block 8 rests upon a resilient shim 9 which in turn rests upon a pedestal 10, the latter intended to be supported by a solid surface (not illustrated).

At the left in FIG. 1, a drive shaft 11 rotates an input shaft 12 in a controlled manner (to be described fully below). The input shaft 12 defines an external keyway 13, while a sleeve-like coupling 14 defines an internal keyway 14*a*. When the keyways 13 and 14*a* are aligned, a key 15 can be received therein, to effectively lock the coupling 14 to the input shaft 12. Also locked to the coupling 14 is a stub shaft 15*a* in which is provided a further keyway 15*b*. As can be seen in FIG. 1, the keyway 15*b* is aligned with the keyway 14*a*, such that the key 15 can lock the coupling 14 simultaneously to both the input shaft 12 and the stub shaft 15*a*.

The stub shaft 15*a* is integral with a transition shaft 16 which is in turn integral with a gear shaft 16*a* which will be described more fully bellow. The transition shaft 16 is supported in a bearing 17 which in turn is held in place with respect to the support block 8 by virtue of a stand-off sleeve 17*a* which has an integral stub sleeve 18 that is received in a cylindrical recess 18*a*, and which in turn supports the bearing 17. The transition shaft 16 passes through the bearing 17. At the rightward side of the support block 8, a rightwardly projecting stub shaft 18*b* is received in a further bearing 18*c*, the latter being snugly received within a cylindrical opening 18*d* in the support block 8.

As best seen in FIG. 1, the gear shaft 16*a* incorporates an integral pinion gear 20 having a pitch circle identified by the numeral 22, and further incorporates an elongate gear portion 24 which supports external teeth 26 constituting a second pinion gear, the latter having a pitch circle identified by the numeral 28.

It will be noted that the pitch circle 28 has a smaller diameter than the pitch circle 22. In the illustrated embodiment, the diameter of the pitch circle 28 is one-half of the diameter of the pitch circle 22.

Provided in the support block 8 are slide bushings 32 (only one illustrated in FIG. 3), which guide a first and second elongated rack 34 and 36 for longitudinal movement along axes 38 and 40, respectively. The racks 34 and 36 are shaped to provide gear teeth adapted to mesh with the pinion gear 24 provided on the gear shaft 16*a*. Thus, it will be seen from an examination of FIGS. 1 and 3 that rotation of the gear shaft 16*a* in a given direction will cause the racks 34 and 36 to move in opposite directions, while reversal of the rotation of the gear shaft 16*a* will likewise reverse the direction of movement of both racks 34 and 36.

A similar structure is associated with the pinion gear 20, the teeth of which mesh with teeth on additional racks 40 and 42 guided by slide bushings 44 and 46.

Because the diameter of the pitch circle 28 is one-half the diameter of the pitch circle 22, rotation of the gear shaft 16*a* will cause the racks 40 and 42 to move twice as far as the racks 34 and 36.

Figure 3:
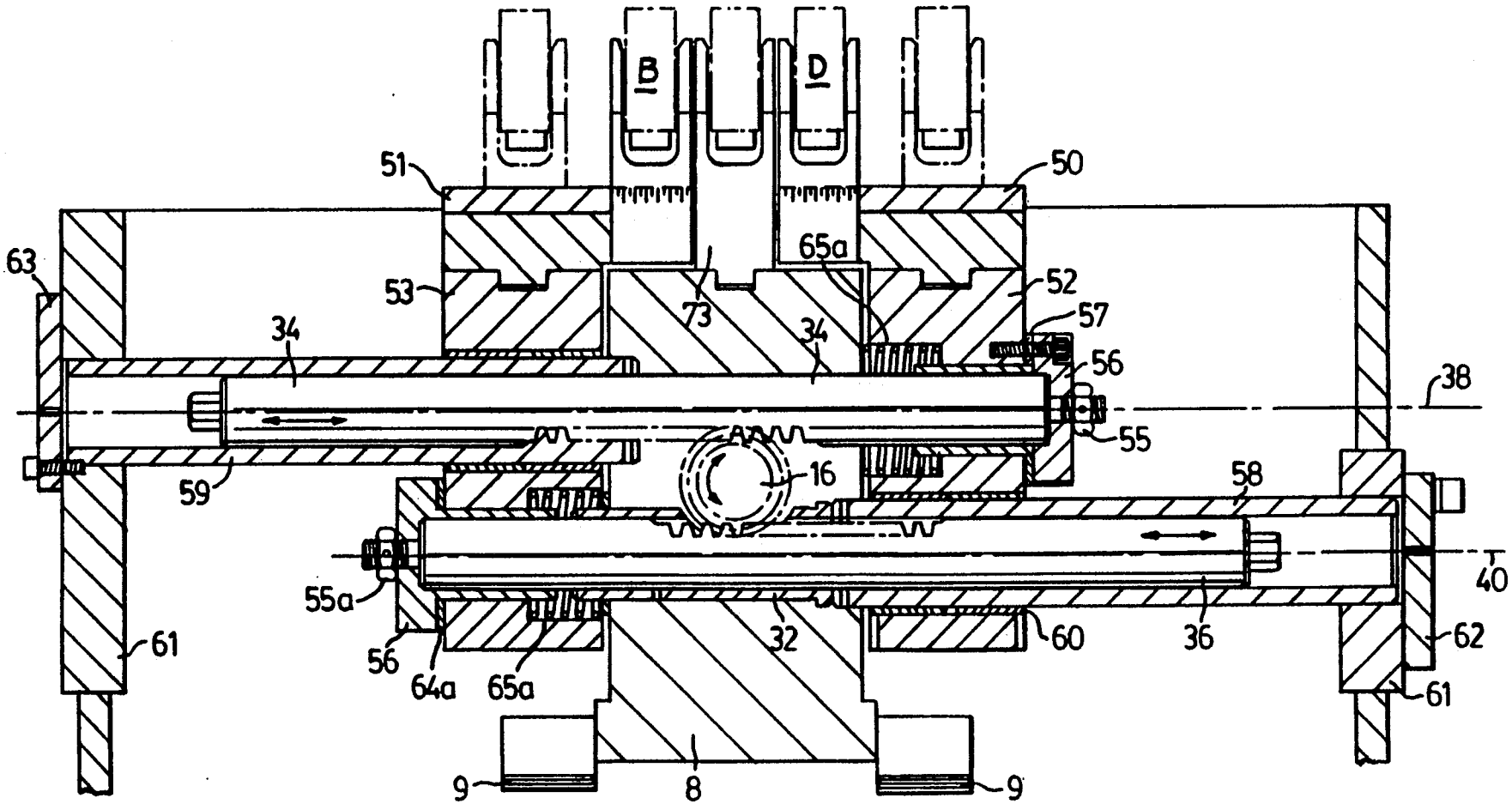
FIG. 3 is a vertical sectional view taken at the line 3–3 in FIG. 1.

Still looking at FIG. 3, the rightward end of the rack 34 and the leftward end of the rack 36 are turned down and threaded, so as to receive respective end caps 56 held in place by jam nuts 55, 55*a* which in turn are pinned in place. The end caps 56 are in turn bolted through fitting spacers 57 and 64*a* to respective trapping finger support blocks 52 and 53 which in turn support respective trapping fingers 50, 51. Compression coil springs 65*a* (drawn schematically) urge the respective racks 34, 36, 40 and 42 away from the support block 8, thus taking up any "slack" in the gear teeth. It will thus be seen that movement of the racks 34 and 36 as a result of rotation of the gear shaft 16*a* will cause the trapping fingers 50, 51 to move and thus displace the parts marked "B" and "D".

It will be noted that support tubes 58, 59, located between the central support block 8 and a primary housing 61, support the racks 34, 36 during their movement. The support tubes 58, 59 also perform a support and anti-rotate function for the trapping finger support blocks 52 and 53.

End plates 62 and 63 are provided adjacent respective ends of the support tubes 58, 59, and have the function of preventing dirt, coolant, etc. from entering the support tubes 58, 59, and to prevent oil from the lubricating racks from leaking out.

Figure 4:
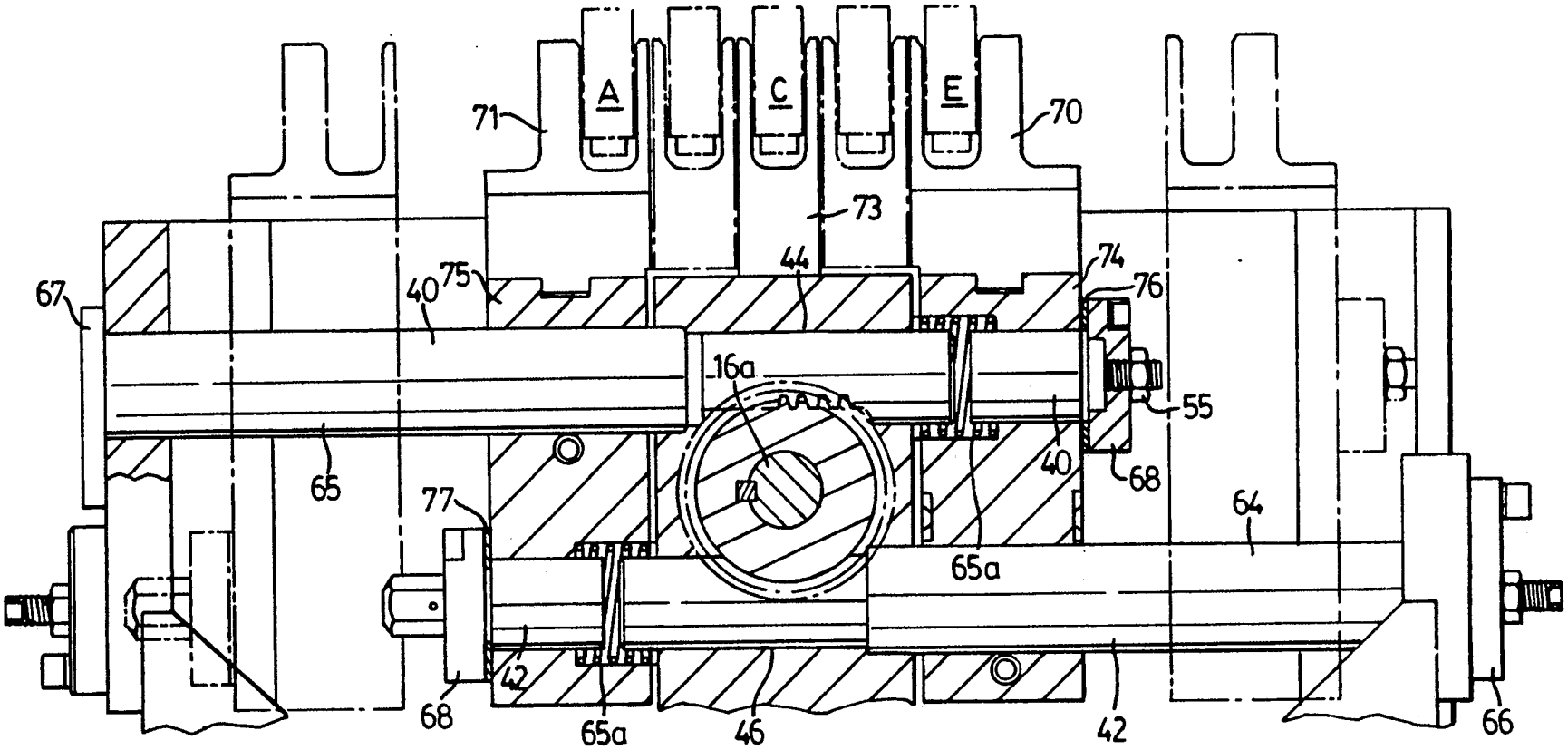
FIG. 4 is a vertical sectional view taken at the line 4–4 in FIG. 1.

In FIG. 4, rotation of the gear shaft 16*a* in a given direction again causes the racks 40, 42 to move oppositely. Reversal of the rotation direction of the gear shaft 16*a* causes the racks also to change direction. Additional support tubes 64, 65 are provided to guide the racks 40 and 42, and end plates 66, 67 are again provided for the same reason as previously described with respect to FIG. 3. In the case of FIG. 4, end caps 68 are bolted through respective spacers 76, 77 to the trapping finger support blocks 74, 75, which in turn support trapping fingers 70, 71. Thus it will be seen that movement of the racks 40, 42 directly causes the trapping fingers to move and displace the parts "A" and "E" identified in FIG. 4. When a fifth part is to be accommodated (part "C" in FIG. 4), it is held in place by a stationary central fifth finger 73.

Figure 2:
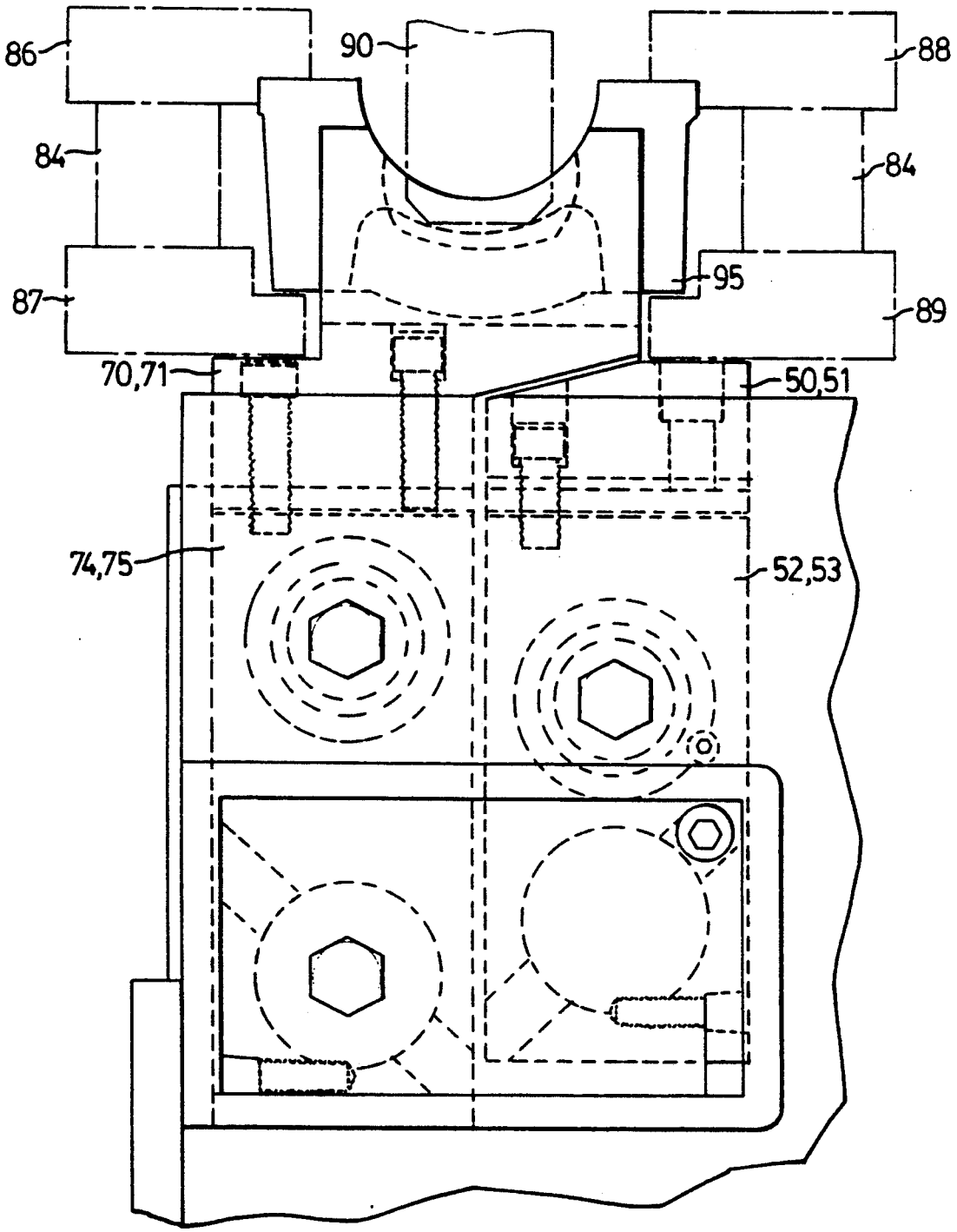
FIG. 2 is an end view of the apparatus of FIG. 1.

FIGS. 1 and 2 show, in broken lines, upper guide rails 86, 87, and lower guide rails 88, 89. Guide rail separators 84 are also provided. Transfer bar fingers 90 can also be seen in FIGS. 1 and 2. A workpiece in the form of a bearing cap 95 is also illustrated in FIGS. 1 and 2.

While one embodiment of this invention has been illustrated in the accompanying drawings and described hereinabove, it will be evident to those skilled in the art that changes and modifications may be made therein, without departing from the essence of this invention, as set forth in the appended claims.

The embodiments of the invention in which an exclusive property or privilege is claimed are defined as follows:

1. An apparatus for moving at least two workpieces from a relatively close spacing to a relatively distant spacing, comprising:

a support block, a gear shaft having an axis of rotation, and being mounted to the support block for rotation about said axis, a pinion gear means on time gear shaft, the pinion gear means rotating with the gear shaft and having pinion gear teeth, a first elongate rack means supported by said support block for longitudinal sliding movement in a direction perpendicular to the axis of rotation of the gear shaft, and defining a first rack of gear teeth meshing with the teeth of said pinion gear means, a second elongate rack means supported by said support block for longitudinal sliding movement parallel with the direction of movement of said first elongate rack means, and defining a second rack of gear teeth meshing with the teeth of said pinion gear means, the first and second elongate rack means engaging the pinion gear means at diametrically opposed locations, whereby rotation of the gear shaft causes the two elongate rack means to slide in opposite directions, first gripping means mounted for movement with the first elongate rack means, the first gripping means being adapted to grip a first workpiece such that the first workpiece, after being gripped, moves with the first elongate rack means, second gripping means mounted for movement with the second elongate rack means, the second gripping means being adapted to grip a second workpiece such that the second workpiece, after being gripped, moves with the second elongate rack means, and drive means for rotating the gear shaft in a controlled manner.

2. The apparatus claimed in claim 1, further comprising:

a further pinion gear means on the gear shaft, the further pinion gear means rotating with the gear shaft and having further pinion gear teeth, a third elongate rack means supported by said support block for longitudinal sliding movement in a direction parallel with the direction of movement of said first elongate rack means, and defining a third rack of gear teeth meshing with the teeth of said further pinion gear means, a fourth elongate rack means supported by said support block for longitudinal sliding movement parallel with the direction of movement of said first elongate rack means, and defining a fourth rack of gear teeth meshing with the teeth of said further pinion gear means, the third and fourth elongate rack means engaging the further pinion gear means at diametrically opposed locations, whereby rotation of the gear shaft causes the third and fourth elongate rack means to slide in opposite directions, third gripping means mounted for movement with the third elongate rack means, the third gripping means being adapted to grip a third workpiece such that the third workpiece, after being gripped, moves with the third elongate rack means, and fourth gripping means mounted for movement with the fourth elongate rack means, the fourth gripping means being adapted to grip a fourth workpiece such that the fourth workpiece, after being gripped, moves with the fourth elongate rack means.

3. The apparatus claimed in claim 2, in which said first-mentioned pinion gear means and said further pinion gear means are spaced apart along the axis of said gear shaft, the two pinion gear means having different pitch circle diameters.

4. The apparatus claimed in claim 3, in which the pitch circle diameter of said first-mentioned pinion gear means is one-half of the pitch circle diameter of said further pinion gear means, whereby the movement of the third and fourth elongate rack means is double that of the first and second elongate rack means.

* * * * *